US005249400A

United States Patent [19]

Turner

[11] Patent Number: 5,249,400

[45] Date of Patent: Oct. 5, 1993

[54] METAL CONSTRUCTION BLOCKING

[75] Inventor: Arthur R. Turner, Terranora, Australia

[73] Assignee: Saf-T Corporation, Pasadena, Calif.

[21] Appl. No.: 839,034

[22] Filed: Feb. 18, 1992

Related U.S. Application Data

[63] Continuation of Ser. No. 602,703, Oct. 24, 1990, abandoned.

[51] Int. Cl.[5] ..... E04B 2/72; E04C 2/32

[52] U.S. Cl. ..... 52/364; 52/34; 52/671; 52/672

[58] Field of Search ..... 52/671, 672, 674, 34, 52/82, 364, 537, 555, 554; 248/200.1, 906; 211/87, 88

[56] References Cited

U.S. PATENT DOCUMENTS

| | | | |
|---|---|---|---|
| 2,063,115 | 12/1936 | Neergaard | 52/674 |
| 2,167,998 | 8/1939 | Reid | 52/674 |
| 2,653,357 | 9/1953 | Sanders et al. | 52/34 |
| 3,162,863 | 12/1964 | Wokas | 52/34 |
| 3,254,464 | 6/1966 | Hoyt, Jr. | 52/300 |
| 3,407,555 | 10/1968 | Pugh | 52/300 |
| 3,458,168 | 7/1969 | White | 52/674 |
| 4,281,491 | 8/1981 | Schonert | 52/481 |
| 4,580,384 | 4/1986 | Hutcheson | 52/537 |
| 4,695,033 | 9/1987 | Imaeda et al. | 52/674 |
| 4,703,593 | 11/1987 | Smolik | 52/34 |
| 4,804,094 | 2/1989 | Eittreim | 211/88 |
| 4,987,619 | 1/1991 | Smith | 52/34 |

FOREIGN PATENT DOCUMENTS

| | | | |
|---|---|---|---|
| 278186 | 10/1927 | United Kingdom | 52/674 |
| 1017226 | 1/1966 | United Kingdom | 52/34 |

*Primary Examiner*—Michael Safavi
*Attorney, Agent, or Firm*—Christie, Parker & Hale

[57] ABSTRACT

A metal construction blocking for wood frame wall stud construction comprising an elongated metal piece having a pair of parallel marginally folded edges having sufficient strength to prevent the blocking from bending, and a longitudinally corrugated body sufficiently thick to allow metal self-tapping screws to pass through the body so that when the blocking is put in place on the wall studs, the blocking holds a fixture with the screws fastening to unsupported portions of the blocking between adjacent wall studs.

18 Claims, 4 Drawing Sheets

METAL CONSTRUCTION BLOCKING

This is a continuation of application Ser. No. 07/602,703, filed Oct. 24, 1990 now abandoned.

FIELD OF THE INVENTION

This invention relates generally to housing framing construction and, more particularly, to a metal blocking used for anchoring wall fixtures to wood frame wall construction.

BACKGROUND OF THE INVENTION

In modern building construction, most wall fixtures, such as towel racks, sinks, medicine cabinets, ceiling light fixtures and moldings, to name a few, are anchored to the wall by securing the fixture to a wooden block located horizontally between the vertical wall studs between the ceiling members or vertically parallel to the wall studs. The wood block is normally of the same dimensions, or wider, as the wall studs, but cut in length to fit snugly between two adjacent studs. The wood block is nailed on each end to secure the block to the studs. The studs and the wood block are covered with wallboard or dry wall and the fixture is then attached by means of nails or screws through the wallboard and into the horizontal face of the wood block.

This invention is based on a recognition that the use of wood blocks as a means for anchoring fixtures to a wall is an inefficient method. One problem associated with the use of wood blocks is that it is very time consuming during construction to cut and fit each block between two adjacent studs. Depending upon the length of the fixture, it may be necessary to put two blocks in series between adjacent pairs of wall studs. Each wood block must fit securely between the two adjacent wall studs, which requires precise measuring and cutting of the wood block.

A second problem associated with the use of wood blocks is that the amount of force or weight that can be placed on the block is limited. When an excessive amount of force or weight created by the size of the fixture is exerted upon the wood block, the wood block has a tendency to pull out from between the two adjacent studs, therefore causing the fixture to not be securely anchored to the wall or the screws or nails can all pull out from the block.

A third problem associated with the use of wood blocks is that since the wood block is normally of the same size as the wall studs, the horizontal surface to which the fixture is secured is relatively narrow. Because this face is so narrow, it can be difficult to find the wood block when attempting to attach the fixture once the wall lining is in place. Also, depending on the height of the fixture, it may be necessary to install a number of wooden blocks vertically between two adjacent studs in order to secure the top and bottom of the fixture.

A final problem associated with the use of wood blocks is that since the blocks are made of wood they have a tendency to crack or splinter under excessive weight or force. If a wood block is pulled loose or crack, or splinter, it can require considerable time and expense to repair, which would include the removal of the wall panels.

Thus, there exists a need for construction blocking that is easy and quick to install and can support a considerable amount of weight.

SUMMARY OF THE INVENTION

The present invention provides an improved construction blocking which eliminates the problems of the prior wood blocking and is simple and inexpensive to manufacture.

In one embodiment, the present invention comprises a steel construction blocking having a pair of parallel ridges formed by folding a metal piece along its top and bottom edges, with the metal piece being otherwise corrugated between the outer metal ridges. The steel blockings are nonstructural metal pieces capable of receiving self-tapping metal screws. The parallel folded edges and the corrugated body section of the metal construction blocking can be easily produced from conventional metal extrusion bending equipment.

The folded edges provide added strength and rigidity to the metal construction blocking as well as providing rounded edges for safety in the handling of the blocking. The corrugated body provides ridges, that also add strength to the blocking, but the primary purpose for the corrugated body is to keep the wallboard from bending inward when a fixture is anchored to the metal blocking, thus maintaining a flush construction.

In use, the metal construction blocking is simply secured to the front faces of the wall studs by conventional nails or screws, and a wall fixture is then secured to the metal blocking with the use of self-tapping screws. The metal blocking provides a strong structural base in the unsupported areas between wall studs for attaching wall fixtures. As a result of the invention, construction time is greatly reduced, as well as providing construction blocking capable of withstanding a greater amount of weight or forces.

These and other aspects of the invention will be more fully understood by referring to the following detailed description and the accompanying drawings.

DETAILED DESCRIPTION

Figure 1:
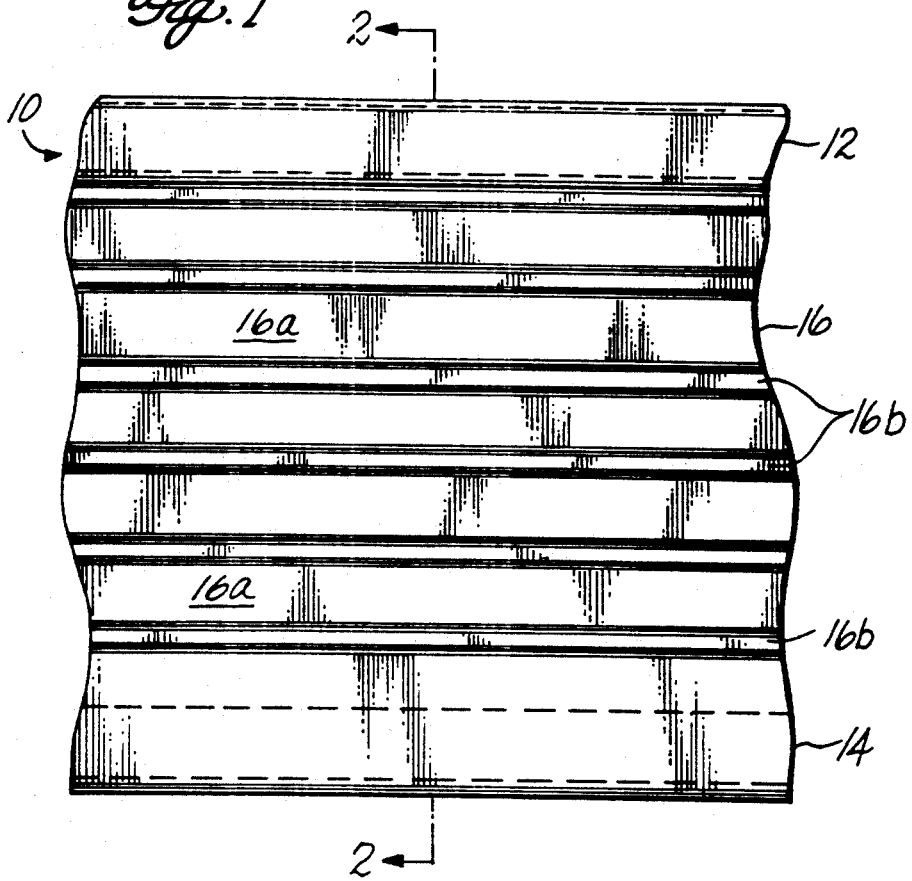
FIG. 1 is a fragmentary front elevational view of the metal construction blocking according to the principles of the invention.
Figure 2:
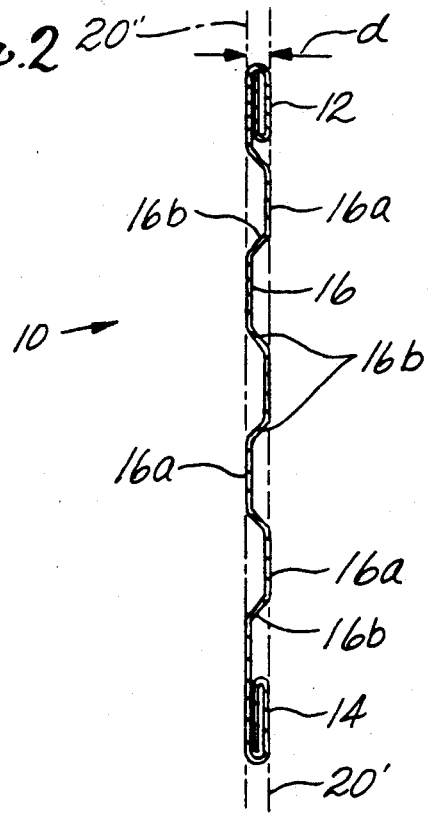
FIG. 2 is a cross sectional view taken on line 2—2 of FIG. 1.

Referring the drawings, FIGS. 1 and 2 illustrate a metal construction blocking 10 constructed in accordance with the principles of this invention. The metal construction blocking 10 comprises a pair of parallel top and bottom ridges 12 and 14, respectively, which lie generally in a common plane. The ridges are formed by bending an elongated metal piece inwardly and folding it back on itself at least once along its top and bottom edges. The metal blocking otherwise has a corrugated body 16 between the outer metal ridges. The corrugations are of a single wall thickness of the metal piece and the corrugations each extend parallel to the long axis of the metal piece. The corrugations are preferably of reasonably uniform width and are formed with wide flat surfaces **16*a*** extending axially along the axis of the metal piece. As shown best in the cross-section of FIG.

2, the metal piece is bent in an alternating pattern of corrugations in which the wide, flat surfaces 16a of the corrugations are interconnected by alternating short angularly disposed intervening sections 16b. The intervening sections 16b are generally uniform in width, and as shown best in FIG. 1, the alternating short intervening sections 16b extend axially generally parallel to each other along the metal piece. The short intervening sections 16b are bent at obtuse angles with respect to the flat outer faces of the metal piece so the flat outer faces on one side of the metal piece are each spaced apart longitudinally and non-overlapping with respect to the adjoining flat outer faces on the opposite side of the metal piece. The thickness of the corrugations, as best shown in FIG. 2, is approximately the same as the thickness of the top and bottom ridges 12 and 14. The wide flat surfaces 16a of the corrugations are substantially wider than the short intervening angular sections 16b between the corrugations, and therefore the flat surfaces 16a of the corrugations are substantially greater in width than the narrow profile thickness "d" of the metal piece, as shown in FIG. 2. The height of the metal blocking can vary as necessary depending upon the height of the fixture to be secured to the blocking. The height can vary from about four inches to about eight inches. The metal blocking is generally made from about 20 to about 28 gauge, and more preferably from about 22 to about 26 gauge metal galvanized steel having a thickness of about 0.03 to 0.022 in., respectively. The metal thickness also can vary depending upon a particular application.

The metal blocking also can be made from an aluminum extrusion. The metal blocking is sufficiently thin for nailing to wall studs and for wall board to nail to studs through it, as described in more detail below.

A significant characteristic of the metal blocking is that it has a sufficient thickness to allow self-tapping screws to pass through, so when put in place, it holds a fixture in place. The folded edges, which can be folded to a multiple thickness and are of flat profile, provide added strength and rigidity to the metal blocking, which resists bending and twisting. The folded edges also create a smooth rounded corner which provides a safety feature in that an installer would not cut his hands on a sharp edge of the blocking while handling the blocking during installation. The preferred technique for forming the upper and lower ridges, as shown in FIG. 2, is to provide a double fold so that the ridges comprise three thicknesses of the metal piece parallel to one another.

A main purpose of the corrugated body, besides adding additional strength and rigidity to the blocking, is to provide a spacing between the wall board and the studs. Without this corrugated body, when the fixture is attached to the metal blocking, the wall board, which is in between the fixture and the metal blocking, tends to be pulled in toward the blocking, as the self-tapping screws are tightened. This bows the metal inward, leaving the exterior surface of the wall board not flush. The corrugated body acts as a spacer preventing the wall board from bowing inward and maintains a flush surface.

The front faces of the outer ridges 12, 14 and alternating corrugations are generally in common flat planes, on either side of the metal piece, as depicted in FIG. 2. This view shows that the outer faces of the marginal folds and corrugations lie reasonably flat against flat surfaces 20' and 20'' on either side of the metal blocking. The dimension "d" shown in FIG. 2 represents the overall average thickness of the blocking which, in one embodiment, is about 1/16 inch.

Figure 3:
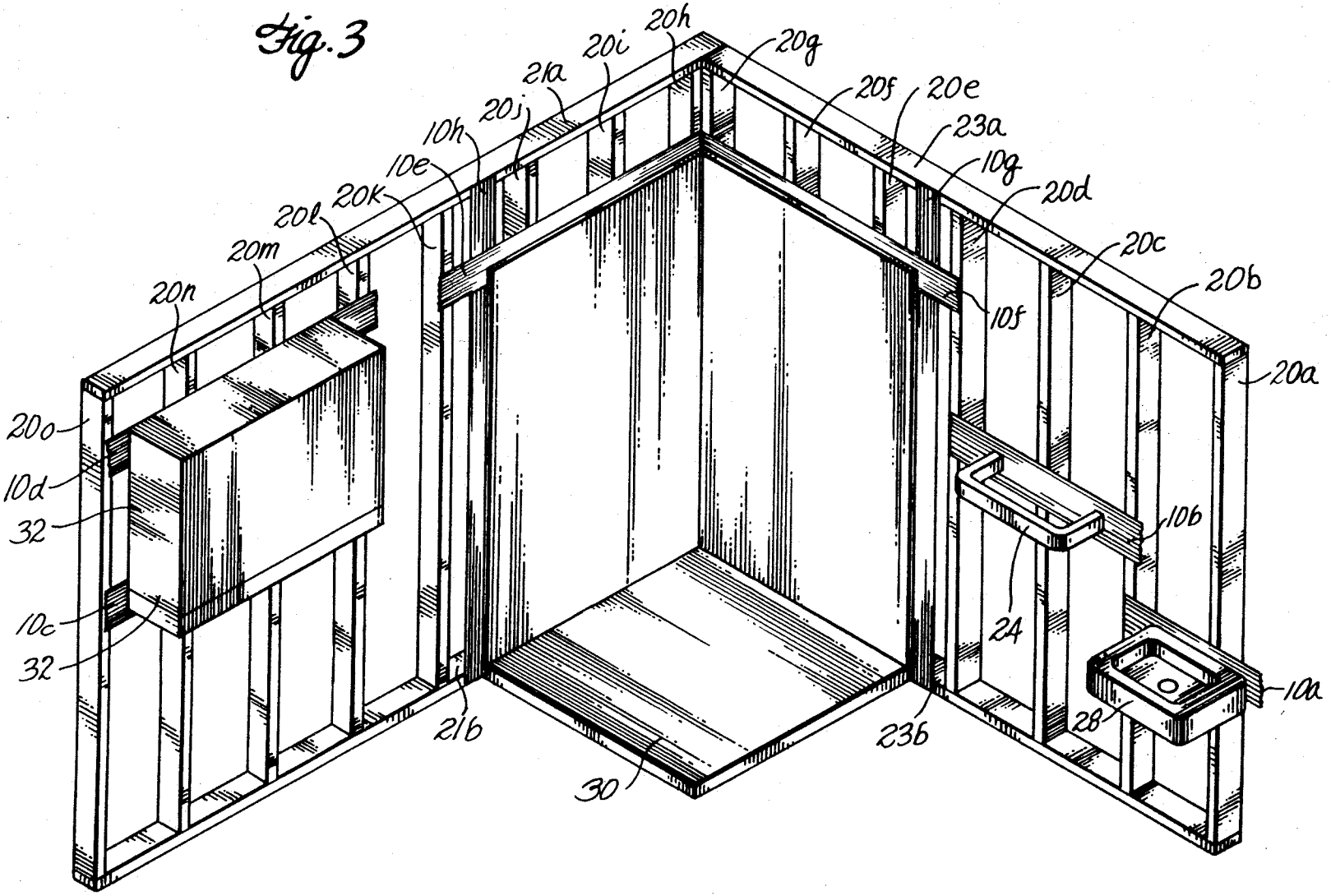
FIG. 3 is a perspective view of the metal construction blocking as incorporated in the construction process.

Referring now to FIG. 3, the metal construction blocking can be seen in actual use. The use of the metal construction blocking allows a fixture to be hung anywhere on a wall without having to depend upon being aligned with a wall stud in order to be anchored to the wall. It is commonly known in the construction industry that the standard width between wall studs is 16 in. Therefore, the construction blocking is preferably precut to predetermined lengths in multiples of 16 in. The length to be chosen will depend upon the width of the fixture to be hung and the position to be hung upon the wall.

Construction blocking 10a has a length long enough to cover two adjacent wall studs 20a and 20b and is used in connection with hanging a fixture 28 such as a sink. Of course, a wall board would be positioned in between the fixtures and the construction blocking, but it is not depicted in this drawing for clarity of illustration. Construction blocking 10b has a length long enough to cover three adjacent wall studs 20b, 20c, and 20d, which is used in connection with securing a fixture 24 which is a towel rack. Construction blockings 10c and 10d are used in a parallel fashion which have a length long enough to extend across four adjacent wall studs 20l, 20m, 20n, and 20o, and are used in connection with hanging a fixture 32, which is a cabinet used for the storage of medicines, towels and the like.

Construction blockings 10e and 10f also have a length which extends across four adjacent wall studs being 20h, 20i, 20j, 20k, and 20d, 20e, 20f, 20g, respectively. Construction blockings 10e and 10f are used in connection with securing a fixture 30 which is a shower stall. In this instance, since fixture 30 has a very tall height a plurality of construction blockings could be mounted horizontally up and down the height of the fixture. Alternatively, construction blockings could be installed vertically as depicted by construction blockings 10h and 10g. Construction blockings 10h and 10g would have a precut length matching the height of the wall framing and connected to top plates 21a and 23a and bottom plates 21b and 23b, respectively.

Figure 4:
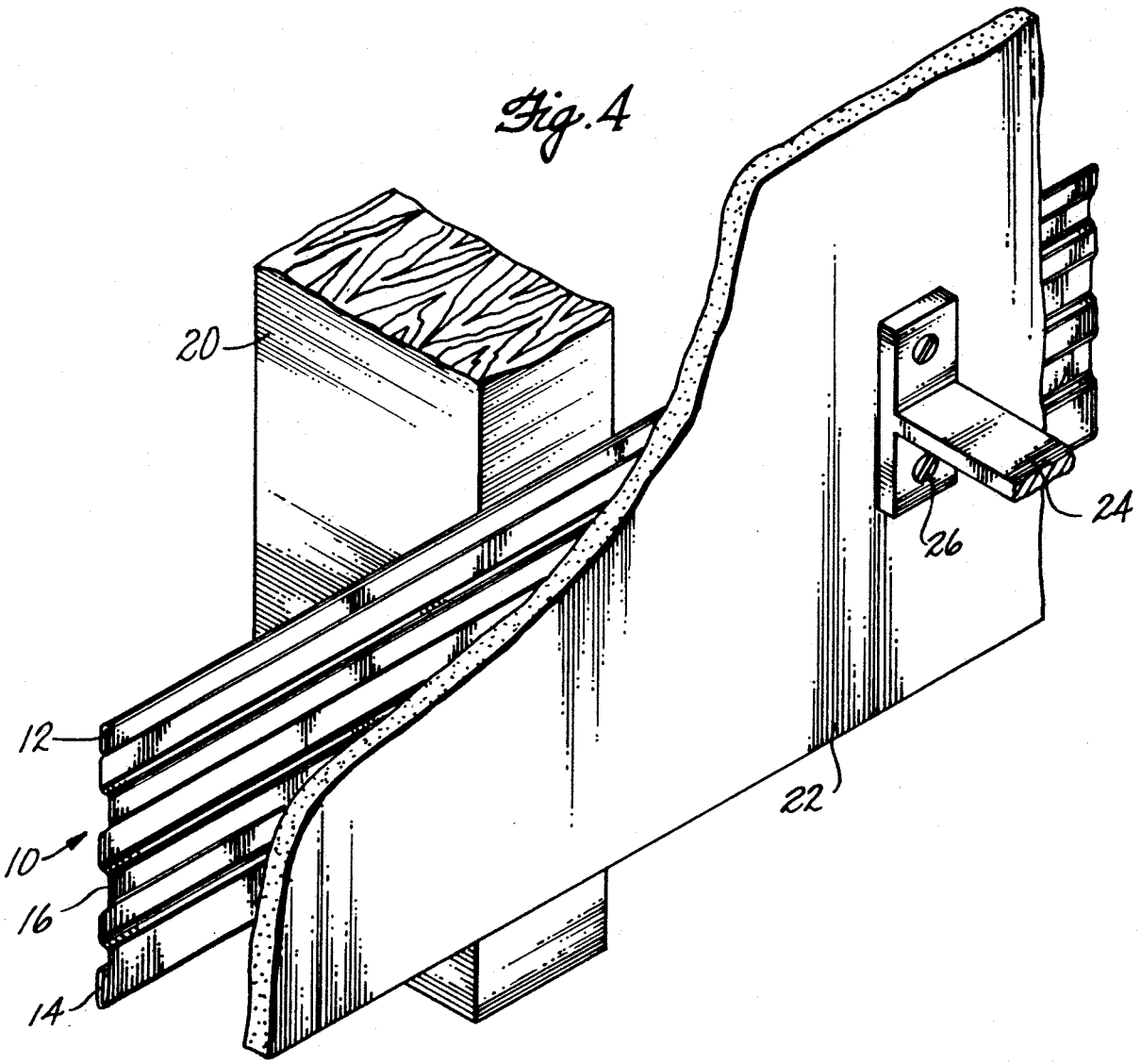
FIG. 4 is an enlarged cutaway front perspective view of FIG. 3.
Figure 5:
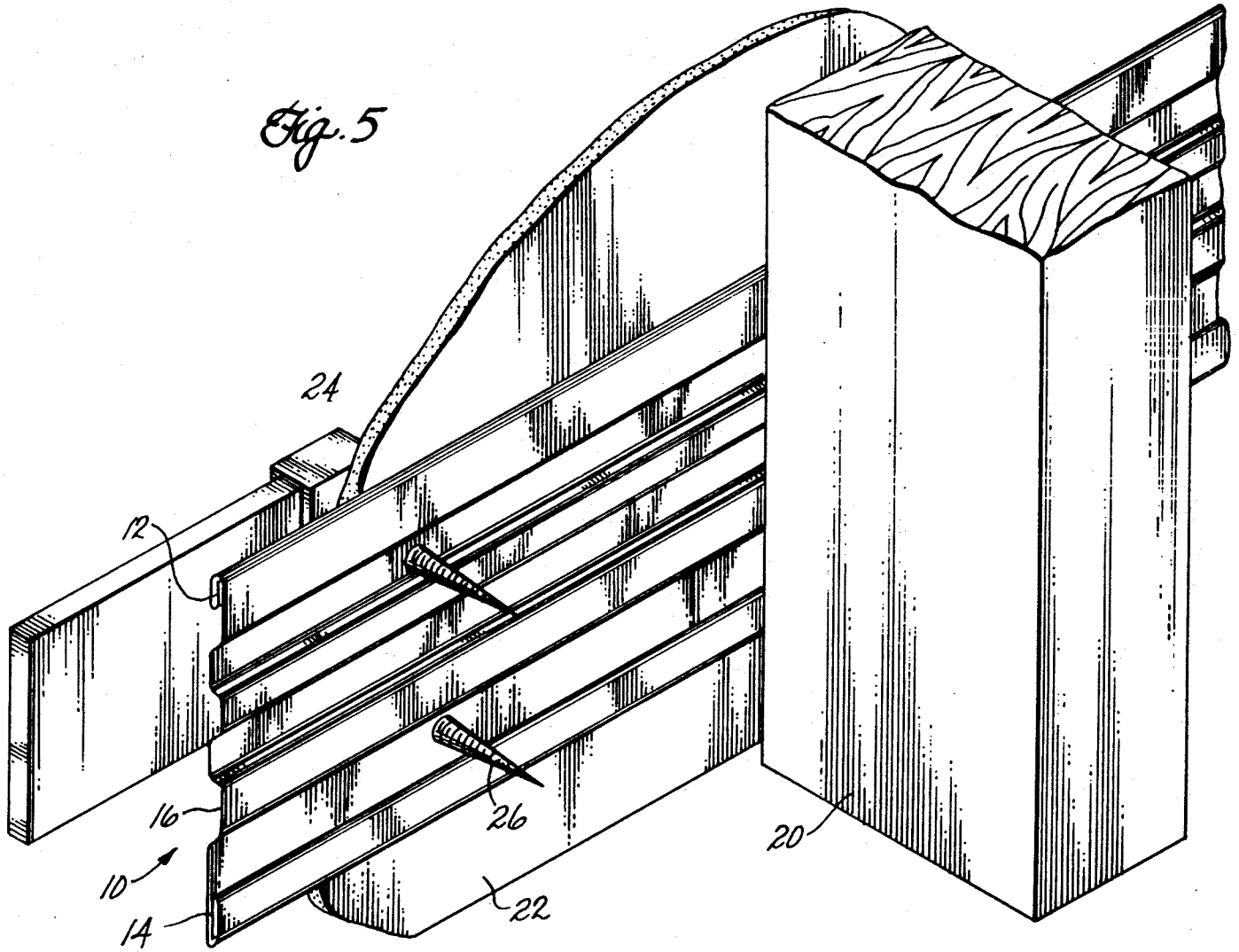
FIG. 5 is an enlarged cutaway rear perspective view of FIG. 3.

FIGS. 4 and 5 are enlarged cutaway perspective views better illustrating use of the present invention. Construction blocking 10 is first attached to wall stud 20 by the use of a nail or a wood screw (not shown) and then the construction blocking is covered with a wall board 22 which is also attached to the wall stud by a nail or wood screw (also not shown). The location of the construction blocking upon the wall studs is determined to coincide with the desired location of a fixture. A fixture 24 is then attached to the wall board 22 at a place that is overlying the construction blocking. The fixture is attached by the use of self-tapping screws 26 which pass through the construction blocking and firmly holds the fixture in place. The use of self-tapping screws eliminates the need to predrill holes in the metal construction blocking which saves times in installation and provides for a better connection between the screw and the construction blocking. The use of the construction blocking allows a fixture to be hung anywhere on a wall regardless of where the wall studs are positioned and provides a support means for an otherwise unsupported back.

The steel construction blocking is used as a replacement for wood blocking which is normally nailed between the wall studs to provide the backing into which a fixture would be attached. As a result of using the self-tapping metal screws and the steel construction blocking, a fixture attached to the wall provides a much better means for structurally holding the fixture to the wall, as opposed to the conventional technique of using wood screws for fastening the fixture into the wood blocking. The steel construction blocking is so strong that it allows a person to stand on a fixture attached to them between the wall studs without the fixture moving, whereas the same fixture attached by wood screws to wood blocking between the studs would easily pull out under the same weight.

As also can be seen in FIGS. 4 and 5, the corrugated body 16 of the construction blocking prevents the wall board 22 and the fixture 24 from being pulled inward as the self-tapping screws are tightened. The corrugated body acts as a spacer and maintains the wall board and the fixture in a flush fashion.

The invention can be used in ceiling or floor construction as well as upright wall construction. The fixtures attached to the wall structure can vary and, for example, can include a sink, towel rack, shower stall, cabinet or molding at the top or bottom o the wall and floor or wall and ceiling.

Although the present invention has been described and is illustrated with respect to a preferred embodiment thereof, it is to be understood that it is not to be so limited, since changes and modifications may be made therein which are within the full intended scope of this invention as hereinafter claimed.

What is claimed is:

1. A combination of a metal construction blocking in a wall construction, the wall construction having a plurality of spaced apart timber wall studs, top and bottom plates above and below the wall studs, a wall board affixed to the studs to span the space between the studs, a fixture, and a metal construction blocking comprising an elongated metal piece having a pair of parallel marginally folded and generally U-shaped edges having sufficient strength to prevent the blocking from bending, and longitudinally extending corrugations between the folded outer edges, the blocking comprising a longitudinally corrugated body of single metal wall thickness between the marginally folded outer edges, wherein the corrugations have alternating substantially flat outer faces extending generally in a pair of common flat planes lying on opposite sides of the metal piece and defining a narrow profile thickness of the metal piece, the metal piece being bent in an alternating corrugated pattern in which the flat outer faces of the corrugations are integrally connected by alternating short intervening sections extending between the planes on opposite sides of the metal piece and thereby defining the narrow profile thickness of the corrugated metal piece, wherein the flat outer faces of the corrugations are substantially wider than the width of the short intervening sections and the flat outer faces are substantially wider than the thickness of the corrugated metal piece, wherein the short intervening sections are bent at obtuse angles with respect to the flat outer faces of the metal piece so the flat outer faces on one side of the metal piece are each spaced apart longitudinally and non-overlapping with respect to the adjoining flat outer faces on the opposite side of the metal piece, and wherein the marginally folded U-shaped edges of the metal piece both generally lie within the common planes defining the thickness of the metal piece, the corrugated metal piece providing a spacer to maintain the wall board in a flush relation to the blocking and being sufficiently thick to allow metal self-tapping screws to pass through the blocking to hold the fixture in place on the wall board, the screws being fastened to unsupport portions of the metal blocking between an adjacent pair of wall studs.

2. The combination according to claim 1 in which the outer folded edge has a double bend within the wall thickness defined by the outer planes.

3. The combination according to claim 1 wherein the blocking is made from galvanized steel having a wall thickness in the range of about 20 to about 28 gauge.

4. A wall construction comprising:

a first timber wall stud;

a second timber wall stud;

a plurality of self-tapping metal screws;

a fixture; and a metal construction blocking comprising an elongated metal piece having a pair of substantially flat profile and generally U-shaped marginally folded edges extending longitudinally along opposite outer edges of the metal piece for adding rigidity to the outer edges of the blocking, and a longitudinally corrugated body of single metal wall thickness between the marginally folded outer edges, wherein the corrugations have alternating substantially flat outer faces extending generally in a pair of common flat planes lying on opposite sides of the metal piece and defining a narrow profile thickness of the metal piece, the metal piece being bent in an alternating corrugated pattern in which the flat outer faces of the corrugations are integrally connected by alternating short intervening sections extending between the planes on opposite sides of the metal piece and thereby defining the narrow profile thickness of the corrugated metal piece, wherein the flat outer faces of the corrugations are substantially wider than the width of the short intervening sections and the flat outer faces are substantially wider than the thickness of the corrugated metal piece, wherein the short intervening sections are bent at obtuse angles with respect to the flat outer faces of the metal piece so the flat outer faces on one side of the metal piece are each spaced apart longitudinally and non-overlapping with respect to the adjoining flat outer faces on the opposite side of the metal piece, and wherein the marginally folded U-shaped outer edges of the metal piece both generally lie within the common plane defining the thickness of the corrugated metal piece, the corrugated metal construction blocking having two opposite ends, one of which is attached to the first timber wall stud and the other is attached to the second timber wall stud, the metal blocking being sufficiently thick to allow the metal self-tapping screws to pass through the blocking so that, when the blocking is put in place between the wall studs, the blocking securely holds the fixture which is attached to portions of the blocking, by the screws, and unsupported regions between the wall studs.

5. A wall construction as recited in claim 4 wherein a wall board is between the metal construction blocking and the fixture.

6. A wall construction as recited in claim 4 wherein the fixture is a sink.

7. A wall construction as recited in claim 4 wherein the fixture is a towel rack.

8. A wall construction as recited in claim 4 wherein the fixture is a shower stall.

9. A wall construction as recited in claim 4 wherein the fixture is a cabinet.

10. A wall construction as recited in claim 4 wherein the blocking is made from galvanized steel having a wall thickness in the range of about 20 to about 28 gauge.

11. A wall construction as recited in claim 4 in which the outer folded edge has a double bend within the wall thickness defined by the outer planes.

12. A wall construction as recited in claim 4 wherein the blocking is made from galvanized steel having a wall thickness in the range of about 20 to about 28 gauge.

13. A metal wall construction blocking comprising an elongated metal piece which in cross-section includes a pair of substantially flat profile and generally U-shaped marginally folded edges extending longitudinally and generally parallel along opposite outer edges of the piece for adding rigidity to the outer edges of the blocking, and a longitudinally corrugated body of single metal wall thickness between the marginally folded outer edges, wherein the corrugations have alternating substantially flat outer faces extending generally in a pair of common flat planes lying on opposite sides of the metal piece and defining a narrow profile thickness of the metal piece, the metal piece being bent in an alternating corrugated pattern in which the flat outer faces of the corrugations are integrally connected by alternating short intervening sections extending between the planes on opposite sides of the metal piece and thereby defining the narrow profile thickness of the corrugated metal piece, wherein the flat outer faces of the corrugations are substantially wider than the width of the short intervening sections and the flat outer faces are substantially wider than the thickness of the corrugated metal piece, wherein the short intervening sections are bent at obtuse angles with respect to the flat outer faces of the metal piece so the flat outer faces on one side of the metal piece are each spaced apart longitudinally and non-overlapping with respect to the adjoining flat outer faces on the opposite side of the metal piece, and wherein the marginally folded U-shaped outer edges of the metal piece both generally lie within the common planes defining the thickness of the narrow profile metal piece, the corrugated body being sufficiently thick to allow self-tapping metal screws to pass through the metal piece so that when the metal piece is put in place between a pair of wall studs, the metal piece holds a fixture attached to portions of the metal blocking which are unsupported by the wall studs.

14. A metal construction blocking as recited in claim 13 wherein the corrugated body extends the entire length of the blocking.

15. A metal construction blocking as recited in claim 13 wherein the blocking is made from galvanized steel having a wall thickness in the range of about 20 to about 28 gauge.

16. A metal construction blocking as recited in claim 13 in which the intervening sections are each bent to extend on an angle from the plane on one side of the metal piece to the plane on the other side of the metal piece.

17. A metal construction blocking as recited in claim 13 in which the outer folded edge has a double bend within the wall thickness defined by the outer planes.

18. A metal construction blocking as recited in claim 13 in which the flat outer faces are of generally uniform width and therefore extend generally parallel to each other, and the short intervening wall sections also are of generally uniform width and extend generally parallel to each other.

* * * * *